US007117771B2

(12) United States Patent
Whiteford

(10) Patent No.: US 7,117,771 B2
(45) Date of Patent: Oct. 10, 2006

(54) SELF-ADJUSTING, LOCKING PLIERS WITH GRIPPING FORCE ADJUSTMENT

(75) Inventor: Carl Whiteford, Westport, CT (US)

(73) Assignee: Smithville, LLC, Westport, CT (US)

( * ) Notice: Subject to any disclaimer, the term of this patent is extended or adjusted under 35 U.S.C. 154(b) by 144 days.

(21) Appl. No.: 11/021,276

(22) Filed: Dec. 23, 2004

(65) Prior Publication Data

US 2006/0137497 A1 Jun. 29, 2006

(51) Int. Cl.
*B25B 7/04* (2006.01)
*B25B 7/12* (2006.01)

(52) U.S. Cl. ..... 81/357; 81/351; 81/356

(58) Field of Classification Search ..... 81/357, 81/351, 354, 356, 359, 360, 363, 367–371, 81/381–386

See application file for complete search history.

(56) References Cited

U.S. PATENT DOCUMENTS

| | | | | | |
|---|---|---|---|---|---|
| 2,514,130 | A | | 7/1950 | Jones | |
| 3,600,986 | A | | 8/1971 | Baldwin, Jr. | |
| 3,793,914 | A | | 2/1974 | Helms | |
| 4,651,598 | A | | 3/1987 | Warheit | |
| 4,662,252 | A | | 5/1987 | Warheit | |
| 4,802,390 | A | | 2/1989 | Warheit | |
| 4,893,530 | A | | 1/1990 | Warheit | |
| 4,922,770 | A | * | 5/1990 | Dlugolecki et al. | 81/357 |
| 5,020,399 | A | * | 6/1991 | Annis et al. | 81/358 |
| 5,060,543 | A | | 10/1991 | Warheit | |
| 5,351,584 | A | | 10/1994 | Warheit | |
| 5,408,904 | A | | 4/1995 | Neff | |
| 6,000,303 | A | * | 12/1999 | Chang | 81/341 |
| 6,095,019 | A | | 8/2000 | Warheit | |
| 6,116,124 | A | | 9/2000 | Ping | |
| 6,161,455 | A | | 12/2000 | Ping | |
| 6,212,978 | B1 | | 4/2001 | Seber et al. | |
| 6,279,431 | B1 | | 8/2001 | Seber et al. | |
| 6,658,971 | B1 | * | 12/2003 | Delbrugge et al. | 81/405 |
| 6,679,140 | B1 | * | 1/2004 | Flavigny | 81/357 |
| 6,748,829 | B1 | * | 6/2004 | Seber et al. | 81/357 |
| 6,941,844 | B1 | * | 9/2005 | Hile | 81/368 |
| 7,044,032 | B1 | * | 5/2006 | Janson | 81/363 |
| 2002/0053263 | A1 | | 5/2002 | Seber et al. | |

* cited by examiner

*Primary Examiner*—Lee D. Wilson
*Assistant Examiner*—Alvin J. Grant
(74) *Attorney, Agent, or Firm*—DeLio & Peterson, LLC; Peter W. Peterson

(57) ABSTRACT

Self-adjusting pliers include first and second elongated members each having at one end a jaw portion and at the other end a handle portion, with the elongated members pivotally connected at a position intermediate the jaw and handle portions such that upon positioning the jaw portions on a workpiece and squeezing the handle portions toward each other, the jaws adjust to thickness of the workpiece as they grip the workpiece. The pliers further include a ratchet locking mechanism between the handle portions, the locking mechanism adapted to releasably secure the handle portions upon squeezing of the handle portions toward each other and gripping of the workpiece by the jaw portions to prevent the handle portions from moving apart. A cam operated adjustor is connected to the locking mechanism to increase pressure of the jaw portions about the workpiece, after securing, by hand pressure alone.

20 Claims, 6 Drawing Sheets

SELF-ADJUSTING, LOCKING PLIERS WITH GRIPPING FORCE ADJUSTMENT

BACKGROUND OF THE INVENTION

1. Field of the Invention

The present invention relates to hand-operated tools and, in particular, to pliers that may be self-adjusted for size and locked on a workpiece, and have the gripping force subsequently increased.

2. Description of Related Art

It is desirable to be able to lock pliers so that the user may release his hands from the pliers while the tool remains firmly gripped about a workpiece held in the jaws. Vice grip-type pliers, as shown in U.S. Pat. Nos. 2,514,130 and 3,600,986, may be locked about a workpiece. Self-adjusting pliers have been known in the prior art, as exemplified by U.S. Pat. Nos. 4,662,252; 4,651,598; 4,802,390; 4,893,530; 5,060,543; 5,351,584 and 5,408,904. While some self-locking features have been disclosed, the design of such features has provided potential problems in manufacture and use. Moreover, whether with vice grip or self-adjusting pliers, after the jaws have been locked in place it is often desirable to be able to increase the gripping pressure of the jaws on the workpiece to a degree beyond what the user may achieve by squeezing the handles.

SUMMARY OF THE INVENTION

Bearing in mind the problems and deficiencies of the prior art, it is therefore an object of the present invention to provide improved hand-operated pliers, particularly self-adjusting pliers, that may be locked in place on the workpiece.

It is another object of the present invention to provide a lock pressure adjustment mechanism for use on pliers that permits jaw pressure to be tightened, e.g., by finger, after the pliers are clamped and locked onto the workpiece.

It is another object of the present invention to provide self-adjusting pliers with improved torsional strength.

Still other objects and advantages of the invention will in part be obvious and will in part be apparent from the specification.

The above and other objects, which will be apparent to those skilled in the art, are achieved in the present invention which is directed to self-adjusting pliers comprising first and second elongated members each having at one end a jaw portion and at the other end a handle portion, with the elongated members pivotally connected at a position intermediate the jaw and handle portions such that upon positioning the jaw portions on a workpiece and squeezing the handle portions toward each other, the jaws adjust to thickness of the workpiece as they grip the workpiece. The pliers further include a locking mechanism between the handle portions, the locking mechanism adapted to releasably secure the handle portions upon squeezing of the handle portions toward each other and gripping of the workpiece by the jaw portions to prevent the handle portions from moving apart, and an adjustor connected to the locking mechanism, the adjustor adapted to increase pressure of the jaw portions about the workpiece, after securing, by hand pressure alone.

Preferably, the adjustor comprises a cam and includes a knob which may be twisted by the user's hand to reduce distance between the handle portions after securing the jaws on the workpiece.

Preferably, the locking mechanism comprises a ratchet, in particular, a pair of arms, with one arm extending from each handle portion, and opposing ratchet teeth associated with the arms to lock the arms in a relative position when the handle portions are squeezed toward each other and prevent the handle portions from moving apart. The ratchet teeth are spring loaded to urge the teeth together to lock the arms in a relative position, and movable away from each other to release the arms and handle portions from their positions and simultaneously release the workpiece from the jaw portions.

In another aspect, the present invention is directed to self-adjusting pliers comprising first and second elongated members each having at one end a jaw portion and at the other end a handle portion. The elongated members are pivotally connected at a position intermediate the jaw and handle portions such that upon positioning the jaw portions on a workpiece and squeezing the handle portions toward each other, the jaws adjust to thickness of the workpiece as they grip the workpiece. The pliers include a locking mechanism between the handle portions, wherein the locking mechanism is adapted to releasably secure the handle portions upon squeezing of the handle portions toward each other and gripping of the workpiece by the jaws. The locking mechanism comprises a pair of arms, with one arm extending from each handle portion, and opposing ratchet teeth associated with the arms to lock the arms in a relative position when the handle portions are squeezed toward each other and prevent the handle portions from moving apart.

The ratchet teeth are preferably spring loaded to urge the teeth together to lock the arms in a relative position, and movable away from each other to release the arms and handle portions from their positions and simultaneously release the workpiece from the jaw portions. The pliers preferably further include an adjustor connected to the locking mechanism, wherein the adjustor is adapted to increase pressure of the jaw portions about the workpiece, after securing, by hand pressure alone. The adjustor may comprise a cam with a knob which may be twisted by the user's hand to reduce distance between the handle portions after securing the jaws on the workpiece.

A further aspect of the invention provides adjustable pliers comprising a first elongated member having at one end a jaw portion and at the other end a handle portion, and further having a throat portion intermediate the jaw and handle portions. The pliers also include a second elongated member having at one end a jaw portion and at the other end a handle portion and further having a throat portion intermediate the jaw and handle portions, with the throat portion containing a slot and a rib at an edge thereof along the slot. The elongated members are pivotally connected at their throat portions such that upon positioning the jaw portions on a workpiece and squeezing the handle portions toward each other, the rib strengthens the second elongated member throat portion against distortion.

Yet another aspect of the invention is directed to self-adjusting pliers comprising a first elongated member having at one end a jaw portion and at the other end a handle portion, and further having a throat portion intermediate the jaw and handle portions, and a second elongated member having at one end a jaw portion and at the other end a handle portion and further having a throat portion intermediate the jaw and handle portions, with the throat portion containing a slot. A ratchet is slidable in the slot of the second elongated member throat. The pliers also include a linking arm connecting the handle portions of the elongated members. The linking arm is pivotally connected at a first end to the first member handle portion, with the linking arm first end being biased by a spring connected to the first member handle portion to move an opposite, second end of the linking arm toward the jaw portions. The linking arm is connected at the second end to the second member handle portion by a spring biased to urge the opposite end against a stop on the second member handle portion. The elongated members are pivotally connected at their throat portions such that upon positioning the jaw portions on a workpiece and squeezing the handle portions toward each other, the jaws slide toward each other against the rotational bias of the linking arm spring to adjust to size of the workpiece, whereupon the ratchet engages the slot in the throat of the second elongated member to enable the jaw portions to grip the workpiece.

A further aspect of the invention provides pliers comprising first and second elongated members each having at one end a jaw portion and at the other end a handle portion. The elongated members are pivotally connected at a position intermediate the jaw and handle portions such that upon positioning the jaw portions on a workpiece and squeezing the handle portions toward each other, the jaw portions grip the workpiece. The pliers include a locking mechanism between the handle portions, wherein the locking mechanism is adapted to releasably secure the handle portions upon squeezing of the handle portions toward each other and gripping of the workpiece by the jaws to prevent the handle portions from moving apart. The pliers also include an adjustor connected to the locking mechanism. The adjustor adapted to increase pressure of the jaw portion about the workpiece, after securing, by hand operation of a user.

In another aspect, the present invention is directed to a method of gripping a workpiece with pliers comprising providing pliers comprising first and second elongated members each having at one end a jaw portion and at the other end a handle portion, the elongated members pivotally connected at a position intermediate the jaw and handle portions; a locking mechanism between the handle portions; and an adjustor connected to the locking mechanism adapted to change the distance between the handles. The method includes positioning the jaw portions on a workpiece, squeezing the handle portions toward each other by hand such that the jaws grip the workpiece, and engaging the locking mechanism to prevent the handle portions from moving apart and maintain gripping of the workpiece by the jaws. While the locking mechanism is engaged, the method includes moving the adjuster by hand to move the handle portions closer together and increase gripping pressure of the jaw portion about the workpiece.

Preferably, the adjustor comprises a cam, and moving the adjustor by hand comprises rotating the cam to move the handle portions closer together.

The locking mechanism may comprises a pair of arms, one arm extending from each handle portion, and opposing spring loaded ratchet teeth associated with the arms to lock the arms in a relative position when the handle portions are squeezed toward each other and prevent the handle portions from moving apart. The method may further include moving the ratchet teeth away from each other to release the arms and handle portions from their positions and simultaneously release the workpiece from the jaw portions. Where the adjustor comprises a cam, the method may also include rotating the cam to move the handle portions farther apart prior to releasing the arms and handle portions from their positions and releasing the workpiece from the jaw portions.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–7 of the drawings in which like numerals refer to like features of the invention.

Figure 3:
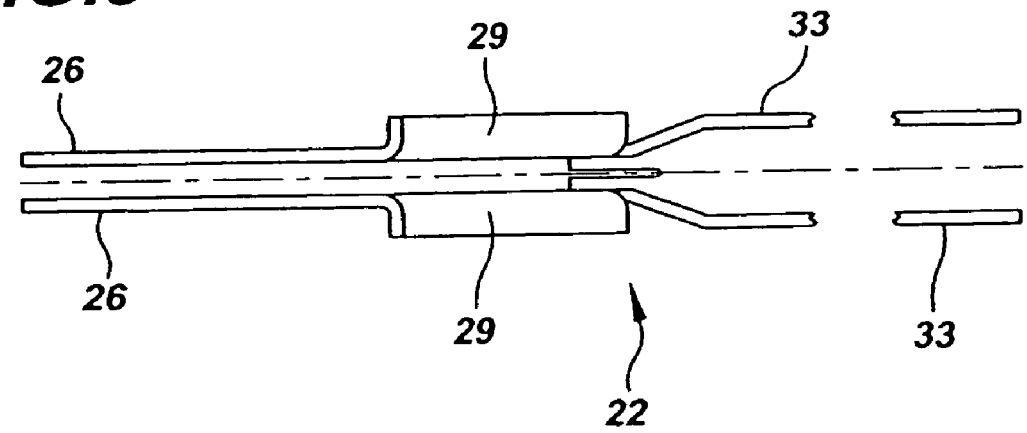
FIG. 3 is an end elevational view of one of the elongated jaw/handle members of the pliers of FIG. 1.
Figure 4:
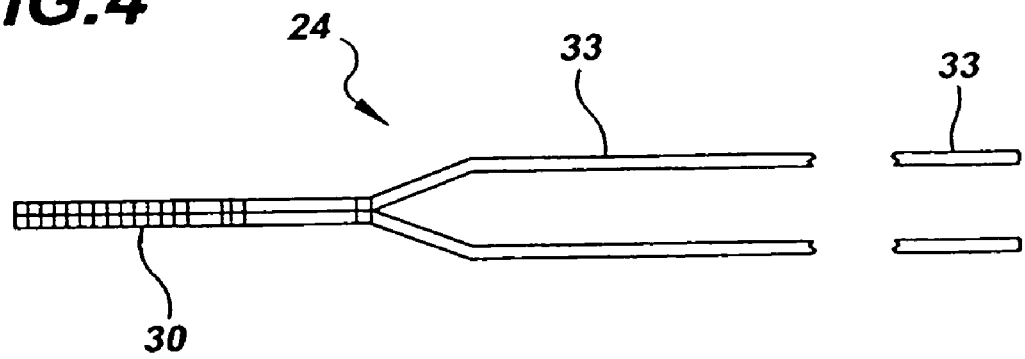
FIG. 4 is an end elevational view of the other of the elongated jaw/handle members of the pliers of FIG. 1.

The preferred embodiment of the present invention 20 is an improvement to prior automatic sizing pliers. Pliers 20 include separate members 22, 24 which have jaw portions at one end and handle portions at the other, and are pivotally connected at intermediate throat portions. Members 22, 24 are shown as being made of cold-formed strip steel as shown in FIGS. 3 and 4, but may be made of any other material of suitable strength, such as forged or cast steel. Member 22 has parallel jaw portions 26, including jaw teeth 28, at the end used to grip the workpiece 21 (FIG. 1), and handle portion 33 at the opposite end. Between the jaw and handle portions of member 22 are parallel throat portions, each containing slot 34 which has on its edge teeth 35. The throat of member 22 preferably includes strengthening ribs 29 of the strip stock bent at a 90° angle to the plane of the throat and jaw portions, and extending essentially parallel to and along slot 34 on the side opposite slot teeth 35. The ribs provide improved torsional strength to the throat portion of member 22, where high tension forces are imparted during use.

Member 24 has complimentary jaw portion 30 and workpiece-gripping teeth 32 at one end, and handle portion 31 at the opposite end. Between member 24 jaw and handle portions is the throat portion containing pivot pin 27, which carries jaw ratchet 38 having teeth on one edge and ratchet disc 36. As shown more clearly in FIG. 2 with disc 36 removed, the teeth of jaw ratchet 38 engage the teeth 35 of slot 34 in member 22 when the jaw has adjusted to the correct size for the workpiece, so that they lock in place and permit the members 22, 24 to pivot around pin 27 as the jaws grip the workpiece. Preferably, slot teeth 35 have twice the pitch of the teeth of jaw ratchet 38.

In order to cause the jaw ratchet to lock at the correct position to self-adjust the jaws to the workpiece size, handles 31, 33 are connected by a jaw opening and closing lever, shown as linking arm 40. Linking arm 40 is connected to handle portion 31 by pin 41, and has an arm portion extending beyond pin 41 connected at opening 43 to a spring 44. Spring 44 is connected at its other end to pin 45 on handle portion 31 at a position away from the jaw portion end, and urges the linking arm to pivot around pin 41 and move the opposite end of the linking arm toward the jaw portions. On handle portion 33 a pin 42 contacts a concave edge of the opposite end of linking arm 40 and stops movement toward the jaw portions. A coil spring 46 is secured at one end to handle portion 33 by pin 47 near the throat portion and connects at the other end to opening 39 in the linking arm opposite end. Spring 46 urges the linking arm to maintain contact with pin 42 and, in doing so, acts to close jaw portion 26 against the workpiece. Spring 44 imparts rotational forces to members 22, 24 relative to the linking arm and cause ratchet disc 36 to disengage from teeth 35 so that jaws 26, 30 open to their maximum opened position. When the pliers are used, the workpiece is placed within the jaws and the handles are squeezed together by the user's hand. The jaw ratchet 38 then slides along slot 34 until the jaws close down to the size of the workpiece and can slide no further with respect to one another, and the gripping jaw ratchet then automatically engages so that the jaws firmly grip the workpiece.

Figure 5:
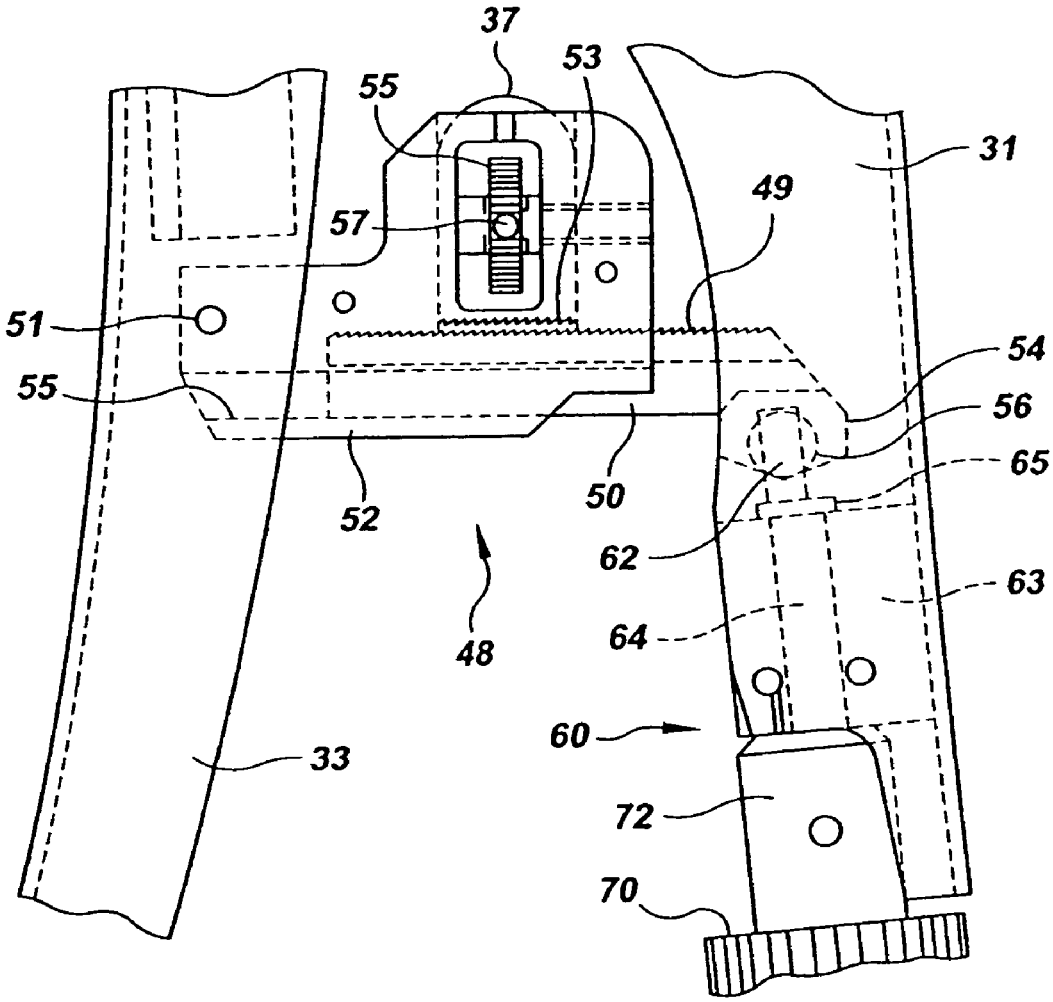
FIG. 5 is a close-up view of the locking mechanism portion between the handles of the pliers of FIG. 1.
Figure 6:
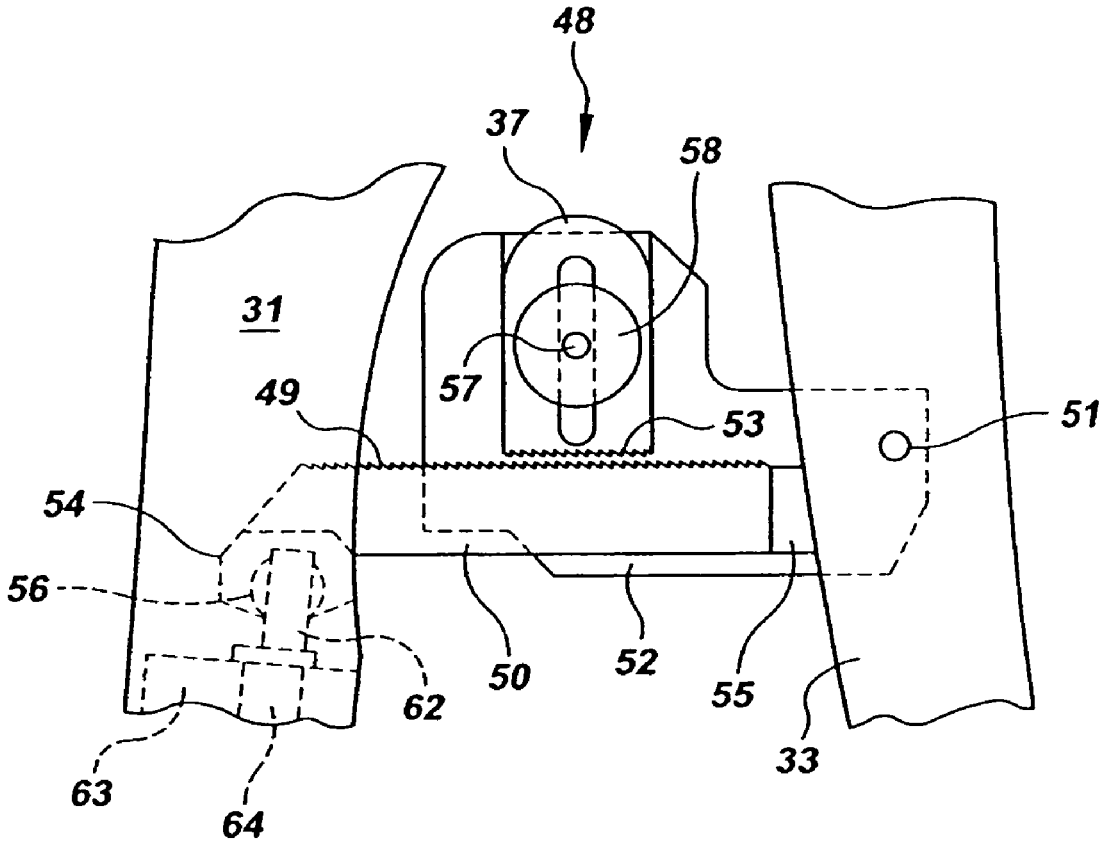
FIG. 6 is a rear view of the locking mechanism portion shown in FIG. 5.

The preferred embodiment of the present invention includes an additional ratchet mechanism 48 to firmly lock the jaws on a workpiece, in the manner of vice grip pliers. Referring to FIGS. 5 and 6, this ratchet mechanism 48 includes opposing arms that extend and meet between the handles, each arm having opposing teeth that are spring loaded against each other so that they can lock when the handles are squeezed together, and prevent the handles from moving apart. To more firmly grip the workpiece after the jaws are set on it, a knob at the end of one handle rotates a cam adjuster at the end of the ratchet arm, and moves the handles slightly closer together.

After the pliers' handles 31, 33 are squeezed together by the user so that jaws 26, 30 are firmly clamped on the workpiece, ratchet mechanism 48 between the handles automatically engages to prevent the handles from separating and maintain gripping pressure. Ratchet mechanism comprises ratchet arms 50, 52 that are movably connected to each other by ratchet teeth 49, 53, respectively. End 54 of ratchet arm 50 is secured to handle portion 31 at a location distal to the jaw portion 30, and preferably includes a lock pressure adjustment mechanism as will be described in more detail below. Ratchet arm 52 is connected by pin 51 to handle portion 33 also at a location distal to jaw portion 26. Ratchet arm 50 slides in a channel 55 formed on one side of ratchet arm 52, and includes teeth 49 formed on one edge thereof. A spring-biased lock ratchet 37 with teeth 53 on one edge thereof slides in a channel in ratchet arm 52, so that lock ratchet teeth 53 engage teeth 49 of ratchet arm 50. Coil spring 55 is located in a slot in lock ratchet 37 (FIG. 5), oriented normal to the edge containing teeth 53, to bias movement of the lock ratchet teeth toward ratchet arm 50 as the slot slides relative to pin 57 in ratchet arm 52. Teeth 49 and teeth 53, having the same pitch, are oriented in opposite directions so that they may slide over one another when the handles 31, 33 are brought toward each other, and engage without sliding to lock the jaws when the user attempts to separate the handles. When so locked, the jaws maintain the initially imparted pressure on the workpiece. Lock release knob 58 (FIG. 6) is secured to one side of lock ratchet 37 to enable the user's finger to move it away from ratchet arm 50 and release the interlocking teeth. The ratchet mechanism described herein may be used with pliers that are not self-adjusting, or pliers that are not adjustable at all.

Figure 7:
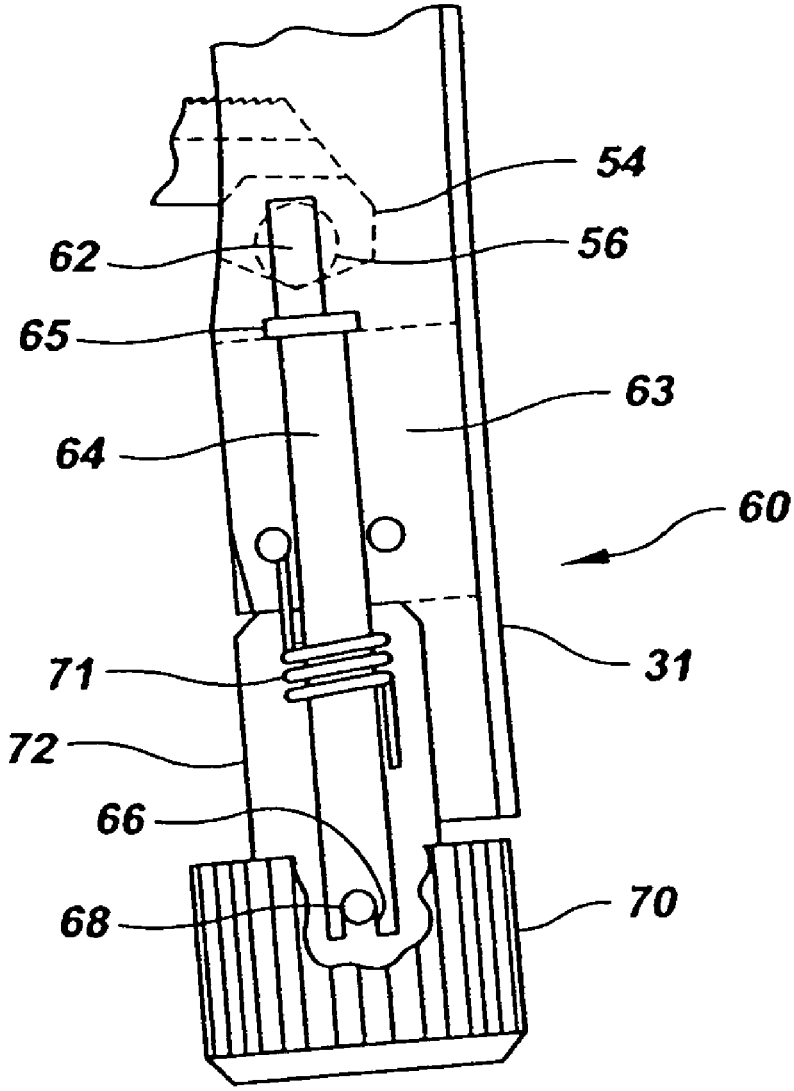
FIG. 7 is a close-up view, partially cut away, of the lock pressure increasing mechanism of the pliers of FIG. 1.

To enable the grip on the workpiece to be further tightened after locking, there is provided a lock pressure adjuster 60 as shown in FIG. 7. The lock pressure adjuster enables the user to move the handle member portions 31, 33 toward each other to increase the pressure on the workpiece gripped in the jaw portions 26, 30 after the locking mechanism 48 has been locked. Specifically, end 54 of ratchet arm 50 has a ball and socket arrangement, where a ball 56 is moveably contained within a comparably sized socket. Ball 56 has a central cylindrical opening and receives a comparably sized cam pin end 62 which is eccentrically secured at the end of shaft 64, so that the central axis of cam pin 62 is off center from the central axis of shaft 64 by a distance equal to one-half the amount of adjustment desired to the handle portions. Adjuster shaft 64 is rotatably mounted within a bearing block 63 secured within the folded walls of the distal end of handle portion 31, and a collar 65 prevents movement of the cam pin into the bearing block opening. The opposite end of shaft 64 is secured within a central axial opening in knurled adjustment knob 70, and has a slot 66 into which is received a pin 68 diametrically mounted in knob 70 to permit the knob to rotate shaft 64. A collar 72 on knob 70 bears against block 63 to prevent shaft 64 from sliding out of the bearing block. Coil torsion spring 71 wraps around shaft 64 in a recess in knob collar 72 and is secured at one end within bearing block 63 and the other end within knob collar 72 to resist in rotating knob 70 in the direction of moving cam pin 62 from a position closer to opposite handle 33 to a position farther from handle 33, and to assist in moving in the opposite direction.

Figure 1:
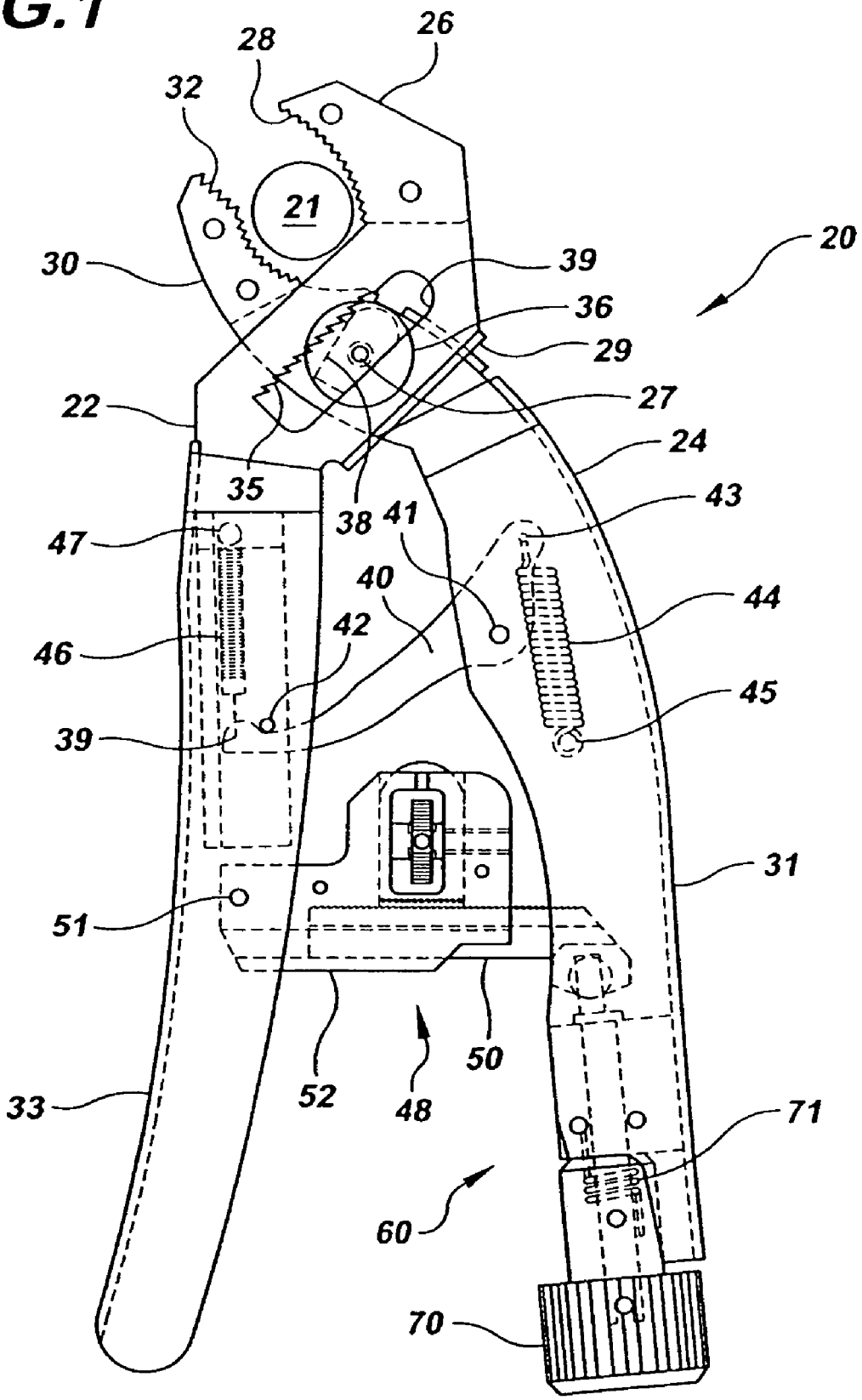
FIG. 1 is a side elevational view of the preferred embodiment of the locking, self-adjusting pliers of the present invention.
Figure 2:
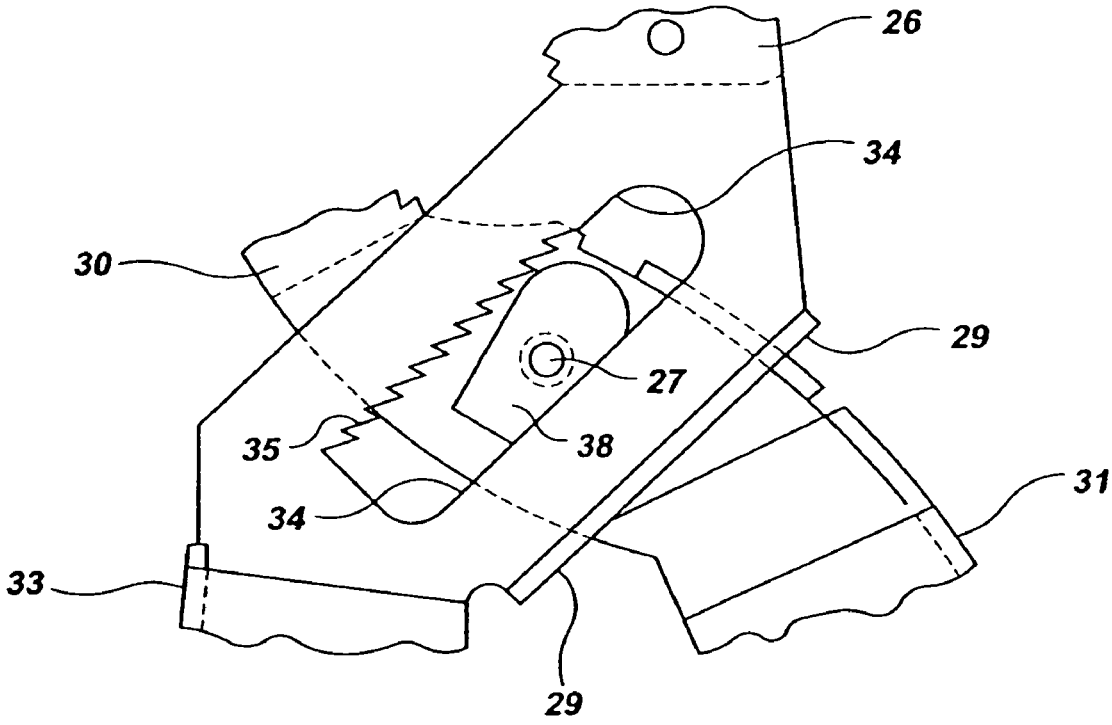
FIG. 2 is a close-up view of the self-adjusting ratchet portion on the throat of the pliers of FIG. 1, with the ratchet disc removed.

As shown in FIGS. 1 and 7, cam pin 62 is in its initial position (closer to opposite handle portion 33) when the locking mechanism is engaged to clamp and lock the self-adjusting jaws in position on the workpiece. Subsequently, the user rotates knob 70 so that cam pin 62 rotates within ball 56 away from handle portion 33 and forces socket 54 to move the end of ratchet arm 50, so that handle portions 31 and 33 move relatively closer. Knob 70 may be rotated up to 180° to move arm 50 a maximum distance, i.e., twice the offset of the pin 62 axis with respect to the shaft 64 axis. A stop is preferably provided to prevent rotation beyond 180°, which then starts to separate the handles. Typically, for an approximately 10 inch (25 cm) long pliers, the pin offset is typically about 0.050 in. (1.25 mm) for a total ratchet arm throw of about 0.100 in. (2.5 mm) and the knob diameter is about 1 in. (25 mm), so that the lock pressure adjustment is readily accomplished by the user's fingers after the tool is clamped down on the workpiece. To aid in unlocking the tool from the workpiece, spring 71 provides additional assistance in rotating the knob in the opposite direction, to separate the handles.

In operation, the user grasps the tool 20 by the handles with one hand, positions the jaws 26, 30 about a desired workpiece, and squeezes the handles together. As the jaw teeth grip the workpiece, the jaws self-adjust to the size of the workpiece and the jaw ratchet disc engages to cause the jaws to lock in the correct relative position to pivot around the workpiece. As the handles move toward each other, the spring-loaded teeth of ratchet mechanism 48 engage to prevent opening of the jaws as they tighten to the desired pressure by the user's direct hand pressure on the handle portions 31, 33. The user may then release his hand from the handles, and the pliers remain locked about the workpiece. If additional jaw pressure is required beyond what can be applied by squeezing of the user's hand, the user may rotate knob 70 with his fingers to engage lock pressure adjuster 60 and dial in additional pressure on the workpiece.

The pliers may be released from the workpiece by sliding lock release knob 58 to disengage the teeth of ratchet mechanism 48, so that the handles are free to move apart. To facilitate such release, it first is necessary to rotate the lock pressure adjustment knob 70 counterclockwise to reduce the jaw clamping pressure.

Thus, the present invention provides improved self-adjusting pliers with improved torsional strength that may be locked in place on the workpiece and subsequently adjusted to increase jaw pressure by simple finger pressure tightening.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Self-adjusting pliers comprising:

first and second elongated members each having at one end a jaw portion and at the other end a handle portion, the elongated members pivotally connected at a position intermediate the jaw and handle portions such that upon positioning the jaw portions on a workpiece and squeezing the handle portions toward each other, the jaws adjust to thickness of the workpiece as they grip the workpiece;

a locking mechanism between the handle portions, the locking mechanism adapted to releasably secure the handle portions upon squeezing of the handle portions toward each other and gripping of the workpiece by the jaw portions to prevent the handle portions from moving apart; and an adjustor connected to the locking mechanism, the adjustor adapted to increase pressure of the jaw portions about the workpiece, after securing, by hand pressure alone.

2. The pliers of claim 1 wherein the adjustor comprises a cam.

3. The pliers of claim 1 wherein the adjustor includes a knob which may be twisted by the user's hand to reduce the distance between the handle portions.

4. The pliers of claim 1 wherein the adjustor is adapted to reduce or increase distance between the handle portions after securing a workpiece.

5. The pliers of claim 1 wherein the locking mechanism comprises a ratchet.

6. The pliers of claim 1 wherein the locking mechanism comprises a pair of arms, one arm extending from each handle portion, and opposing ratchet teeth associated with the arms to lock the arms in a relative position when the handle portions are squeezed toward each other and prevent the handle portions from moving apart.

7. The pliers of claim 6 wherein the ratchet teeth are spring loaded to urge the teeth together to lock the arms in a relative position, and movable away from each other to release the arms and handle portions from their positions and simultaneously release the workpiece from the jaw portions.

8. Self-adjusting pliers comprising:

first and second elongated members each having at one end a jaw portion and at the other end a handle portion, the elongated members pivotally connected at a position intermediate the jaw and handle portions such that upon positioning the jaw portions on a workpiece and squeezing the handle portions toward each other, the jaws adjust to thickness of the workpiece as they grip the workpiece; and a locking mechanism between the handle portions, the locking mechanism adapted to releasably secure the handle portions upon squeezing of the handle portions toward each other and gripping of the workpiece by the jaws, the locking mechanism comprising a pair of arms, one arm extending from each handle portion, and opposing ratchet teeth associated with the arms to lock the arms in a relative position when the handle portions are squeezed toward each other and prevent the handle portions from moving apart.

9. The pliers of claim 8 wherein the ratchet teeth are spring loaded to urge the teeth together to lock the arms in a relative position, and movable away from each other to release the arms and handle portions from their positions and simultaneously release the workpiece from the jaw portions.

10. The pliers of claim 8 further including an adjustor connected to the locking mechanism, the adjustor adapted to increase pressure of the jaw portions about the workpiece, after securing, by hand pressure alone.

11. The pliers of claim 10 wherein the adjustor comprises a cam.

12. The pliers of claim 10 wherein the adjustor includes a knob which may be twisted by the user's hand to reduce distance between the handle portions.

13. The pliers of claim 1 wherein the adjustor is adapted to reduce or increase distance between the handle portions after securing.

14. Adjustable pliers comprising:

a first elongated member having at one end a jaw portion and at the other end a handle portion, and further having a throat portion intermediate the jaw and handle portions; and a second elongated member having at one end a jaw portion and at the other end a handle portion and further having a throat portion intermediate the jaw and handle portions, the throat portion containing a slot and a rib at an edge thereof along the slot, the elongated members being pivotally connected at their throat portions such that upon positioning the jaw portions on a workpiece and squeezing the handle portions toward each other, the rib strengthens the second elongated member throat portion against distortion.

15. Self-adjusting pliers comprising:

a first elongated member having at one end a jaw portion and at the other end a handle portion, and further having a throat portion intermediate the jaw and handle portions;

a second elongated member having at one end a jaw portion and at the other end a handle portion and further having a throat portion intermediate the jaw and handle portions, the throat portion containing a slot;

a ratchet slidable in the slot of the second elongated member throat; and a linking arm connecting the handle portions of the elongated members, the linking arm being pivotally connected at a first end to the first member handle portion, the linking arm first end being biased by a spring connected to the first member handle portion to move an opposite, second end of the linking arm toward the jaw portions, the linking arm being connected at the second end to the second member handle portion by a spring biased to urge the opposite end against a stop on the second member handle portion, the elongated members being pivotally connected at their throat portions such that upon positioning the jaw portions on a workpiece and squeezing the handle portions toward each other, the jaws slide toward each other against the rotational bias of the linking arm spring to adjust to size of the workpiece, whereupon the ratchet engages the slot in the throat of the second elongated member to enable the jaw portions to grip the workpiece.

16. Pliers comprising:

first and second elongated members each having at one end a jaw portion and at the other end a handle portion, the elongated members pivotally connected at a position intermediate the jaw and handle portions such that upon positioning the jaw portions on a workpiece and squeezing the handle portions toward each other, the jaw portions grip the workpiece;

a locking mechanism between the handle portions, the locking mechanism adapted to releasably secure the handle portions upon squeezing of the handle portions toward each other and gripping of the workpiece by the jaws to prevent the handle portions from moving apart; and an adjustor connected to the locking mechanism, the adjustor adapted to increase pressure of the jaw portion about the workpiece, after securing, by hand operation of a user.

17. A method of gripping a workpiece with pliers comprising:

providing pliers comprising first and second elongated members each having at one end a jaw portion and at the other end a handle portion, the elongated members pivotally connected at a position intermediate the jaw and handle portions; a locking mechanism between the handle portions; and an adjustor connected to the locking mechanism adapted to change the distance between the handles;

positioning the jaw portions on a workpiece;

squeezing the handle portions toward each other by hand such that the jaws grip the workpiece;

engaging the locking mechanism to prevent the handle portions from moving apart and maintain gripping of the workpiece by the jaws; and while the locking mechanism is engaged, moving the adjuster by hand to move the handle portions closer together and increase gripping pressure of the jaw portion about the workpiece.

18. The method of claim 17 wherein the adjustor comprises a cam, and wherein moving the adjustor by hand comprises rotating the cam to move the handle portions closer together.

19. The method of claim 17 wherein the locking mechanism comprises a pair of arms, one arm extending from each handle portion, and opposing spring loaded ratchet teeth associated with the arms to lock the arms in a relative position when the handle portions are squeezed toward each other and prevent the handle portions from moving apart, and further including moving the ratchet teeth away from each other to release the arms and handle portions from their positions and simultaneously release the workpiece from the jaw portions.

20. The method of claim 19 wherein the adjustor comprises a cam, and wherein moving the adjustor by hand comprises rotating the cam to move the handle portions closer together, and further including rotating the cam to move the handle portions farther apart prior to releasing the arms and handle portions from their positions and releasing the workpiece from the jaw portions.

* * * * *